US011602871B2

(12) United States Patent
Larson

(10) Patent No.: US 11,602,871 B2
(45) Date of Patent: Mar. 14, 2023

(54) SHEET GUIDE DEVICES

(71) Applicant: HEWLETT-PACKARD DEVELOPMENT COMPANY, L.P., Spring, TX (US)

(72) Inventor: David B. Larson, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/395,065

(22) Filed: Aug. 5, 2021

(65) Prior Publication Data

US 2023/0039464 A1 Feb. 9, 2023

(51) Int. Cl.

| | |
|---|---|
| ***B65H 5/36*** | (2006.01) |
| ***B27F 7/17*** | (2006.01) |
| ***B65H 37/04*** | (2006.01) |

(52) U.S. Cl.

CPC ..... *B27F 7/17* (2013.01); *B65H 5/36* (2013.01); *B65H 37/04* (2013.01)

(58) Field of Classification Search

CPC ..... G03G 2215/00827; B65H 37/04; B65H 5/36; B65H 2301/36; B65H 2408/12; B65H 9/04; H04N 1/0066; H04N 1/00615; H04N 1/00639

USPC ..... 270/58.08; 271/213, 224

See application file for complete search history.

(56) References Cited

U.S. PATENT DOCUMENTS

| | | | | |
|---|---|---|---|---|
| 4,497,478 | A * | 2/1985 | Reschenhofer | B65H 39/10 270/58.11 |
| 5,098,074 | A * | 3/1992 | Mandel | B42C 1/12 270/58.13 |
| 5,404,805 | A * | 4/1995 | Fujimoto | B65H 29/70 101/2 |
| 6,701,841 | B2 * | 3/2004 | Tsurumaki | B65H 29/70 101/420 |
| 7,207,556 | B2 | 4/2007 | Saitoh et al. | |
| 7,222,770 | B2 | 5/2007 | Yoshie | |
| 7,690,636 | B2 * | 4/2010 | Noh | G03G 15/6573 270/58.11 |
| 7,900,804 | B2 | 3/2011 | Hakozaki et al. | |
| 8,210,527 | B2 * | 7/2012 | Kawaguchi | B65H 29/242 271/200 |
| 11,312,589 | B2 * | 4/2022 | Egawa | B41J 13/223 |

* cited by examiner

*Primary Examiner* — Leslie A Nicholson, III

(74) *Attorney, Agent, or Firm* — Brooks, Cameron & Huebsch, PLLC

(57) ABSTRACT

An example sheet guide devices comprises a housing and a guide member coupled to the housing. The housing is to receive a stack of sheets to staple. The guide member includes a cylinder shaft, a counterbalance component, and guide arm. The cylinder shaft is rotatable and disposed within the housing. The counterbalance component is disposed with the cylinder shaft to shift a center of gravity of the guide member in a first direction. The guide arm is disposed off-center from a central axis of the cylinder shaft in a second direction.

19 Claims, 13 Drawing Sheets

SHEET GUIDE DEVICES

BACKGROUND

Printing devices may have integrated staplers for stapling together stacks of sheets generated by the printing device, or re-stapling a stack of sheets that was sent through an automatic document feeder. Such integrated staplers may provide corner stapling on a corner of a stack of sheets and/or edge stapling on a side or edge of the stack of sheets.

DETAILED DESCRIPTION

Figure 1:
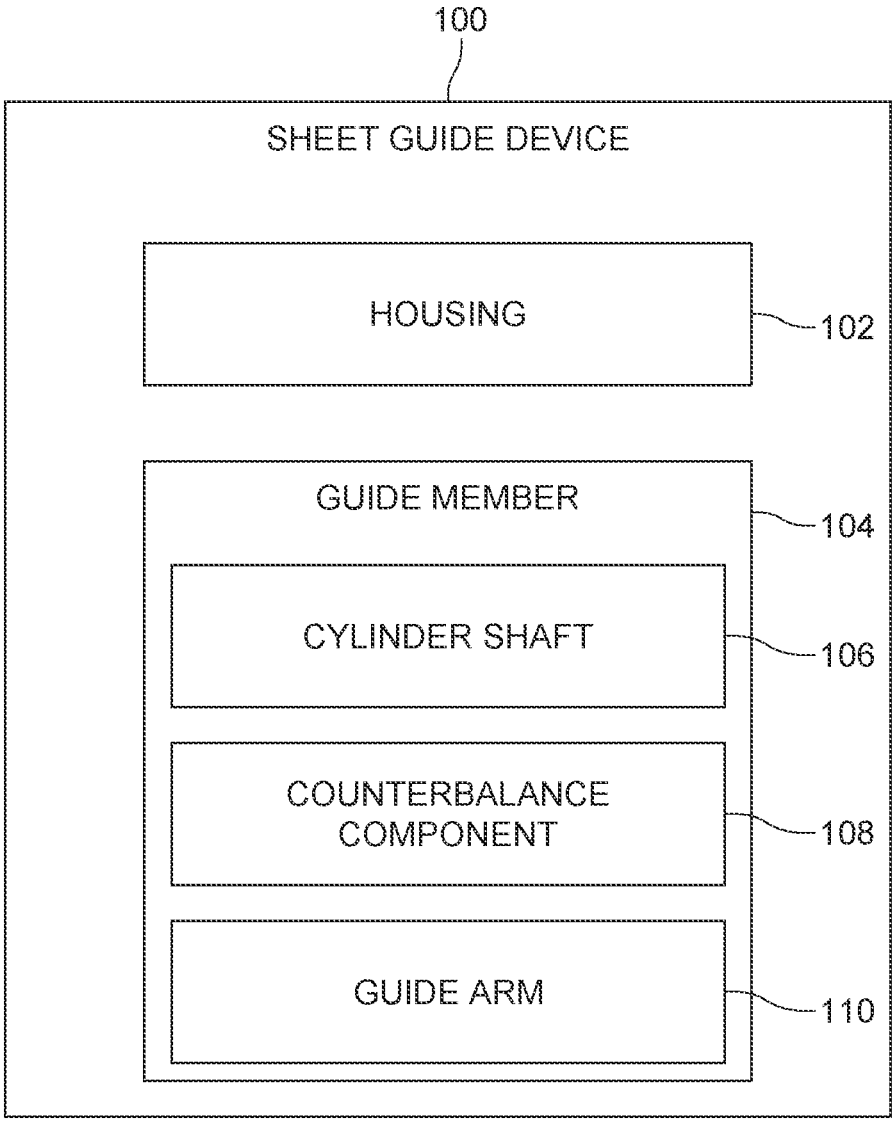
FIG. 1 illustrates an example sheet guide device, in accordance with examples of the present disclosure.

In the following detailed description, reference is made to the accompanying drawings which form a part hereof, and in which is shown by way of illustration of specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Documents may be used to disseminate information and may include printed forms. A printed document may be produced by a printing device based on data received from a computing device, which is printed onto a stack of sheets of paper, here in generally referred to as "a stack of sheets". The printing device may form markings using marking material, such as using liquid print fluids or powdered toner, on the print media based on the data received. Various types of printing device may include an integrated stapler. The stapler may be used to staple stacks of sheets together. The stapler may provide different types of stapling, such as an edge staple and a corner staple, depending on the type of document, the number of sheets, and/or user preference, among other variables. As used herein, a corner staple or stapling includes and/or refers to stapling a stack of sheets at a corner of the sheets, such as the upper left-hand corner. In some examples, the corner staple may be at an angle, such as a 45 degree angle from the corner. In some examples, the corner staple may be parallel to the left edge of the sheets. An edge staple or stapling includes and/or refers to stapling a stack of sheets along an edge of the sheets, such as along the left edge of the sheets. The edge staple may be parallel to and along the left edge of the sheets.

Examples in accordance with the present disclosure are directed to sheet guide devices for a stapler that selectively guides stacks of sheets for both corner stapling and edge stapling. The sheet guide device includes a housing and a guide member that transitions between two states to provide the different types of stapling. The guide member includes a guide arm disposed off-center from a central axis of a cylinder shaft and a counterbalance component that shifts a center of gravity of the guide member in a first direction, such that the guide arm is raised due to gravity when in a first state. In the first state, the guide arm protrudes through a slot aperture in the housing and a guide surface of the guide arm forms or acts as a vertical wall that a stack of sheets may be pressed against from the side and that guides the sheets together for a corner staple. The guide arm has a ramped side surface, which the stack of sheets may be guided over, the force of which causes the guide member to rotate until the guide arm is contained within the housing and may not impede the stack of sheets for an edge staple. The movement or lack of movement of the guide member is due to the way the user presents the stack of sheets, as may be natural movement for attempting a corner staple or edge staple.

Turning now to the figures, FIG. 1 illustrates an example sheet guide device, in accordance with examples of the present disclosure. The sheet guide device 100 may be used to guide a stack of sheets to a stapler that is integrated with a printing device. In some examples, the sheet guide device 100 may be integrated with the printing device and/or the stapler.

The sheet guide device 100 includes a housing 102 and a guide member 104. The housing 102 is to receive a stack of sheets to staple. Sheets include and/or refer to a medium that may have content thereon, such as a content printed by a printing device on paper. Example medium includes different types of paper and fabric. A stack of sheets includes and/or refers to a plurality of sheets that are stacked on top of one another.

The guide member 104 is coupled to the housing 102. The guide member 104 may include a cylinder shaft 106, a counterbalance component 108, and a guide arm 110. The cylinder shaft 106 is rotatable and disposed within the housing 102. The counterbalance component 108 is disposed with the cylinder shaft 106 to shift a center of gravity of the guide member 104 in a first direction. The guide arm 110 may be disposed off-center from a central axis of the cylinder shaft 106 in a second direction.

As used herein, the counterbalance component 108 includes and/or refers to a component that provides, shifts, and/or tilts the center of gravity or the balance of the guide member 104 and/or the cylinder shaft 106. The counterbalance component 108 may cause the guide arm 110 to be in an upright position and to protrude through a slot aperture and extend above a planar surface of the housing 102 of the sheet guide device 100.

The housing 102 may include the planar surface to receive the stack of sheets and the slot aperture disposed proximal to the guide arm 110. The guide arm 110 may retractably protrude through the slot aperture and a distance above the planar surface. In some examples, the housing 102 includes a platform portion including the planar surface and the slot aperture, and a base portion coupled to the platform portion. The base portion and the platform portion may include supports to couple to the cylinder shaft 106 such that the guide member 104 is rotatably mounted within the housing 102. For example, the supports may allow for rotational movement of the cylinder shaft 106.

The guide member 104 may be in a first state or a second state. In the first state, the cylinder shaft 106 is in a first rotated position and the guide arm 110 retractably protrudes through the slot aperture of the housing 102. In the second state, the cylinder shaft 106 is in a second rotated position and the guide arm 110 is within the housing 102. For example, the guide arm 110 may be beneath and/or is not blocking the planar surface of the housing 102.

The guide arm 110 may include a guide surface disposed perpendicular to the planar surface of the housing 102 to guide the stack of sheets. The guide arm 110 may further include a ramped side surface disposed at an angle with respect to the platform surface, as further illustrated herein. The guide surface may form a vertical wall when the guide member 104 is in the first state. The ramped side surface may be used to guide a stack of sheets over the guide member 104 and cause rotational movement of the cylinder shaft 106 such that the guide member transitions to the second state.

While in the first state, the guide member 104 may not rotate when presented with a stack of papers that presses on the guide surface from the side, and may guide the stack of papers to the stapler for a corner staple. While in the second state, the guide member 104 is rotated such that the guide arm 110 may not impede further movement of the stack of papers, and the stack of papers may be guided to the stapler for an edge staple. For example, the ramped side surface may protrude through the slot aperture to guide the stack of sheets over the guide member 104 and to cause the rotational movement of the cylinder shaft 106 such that the guide arm 110 is rotated toward and within the housing 102. After removing the stack of papers, the guide member 104 may return to the first state.

In some examples, the counterbalance component 108 includes a counterweight disposed off-center from the central axis of the cylinder shaft 106 in the first direction. As used herein, a counterweight includes and/or refers to a weight that is disposed on the cylinder shaft 106 to provide, shift, and/or tilt the center of gravity (or balance) of the guide member 104.

In some examples, the counterbalance component 108 includes a torsion spring disposed within the housing 102 to provide a return force to the guide member 104 in the first direction. A torsion spring, as used herein, includes and/or refers to coils that are wound together and that exerts a torque or rotary force in the first direction, and that may resist other twisting or rotational forces. In response to a load applied to the torsion spring, legs of the torsion spring may store and release angular energy by rotating positions. In response to removal of the load, the torsion spring may return to an original rotational position. In further examples, the counterbalance component 108 includes the counterweight and the torsion spring.

As previously described, the housing 102 may include supports coupled to a first end and a second end of the cylinder shaft 106. The supports may allow rotational movement of the cylinder shaft 106, such as allowing for pivoting of the cylinder shaft 106 to transition between the first state and the second state of the guide member 104. The housing 102 may further include a protrusion disposed to prevent rotation movement of the cylinder shaft 106 past a threshold rotated position. For example, the protrusion may limit an angle of axial rotation of the cylinder shaft 106.

The housing 102, guide member 104, and components thereof may be formed of a metal material, plastic or polymer material, and/or an alloy material, among other types of materials.

Figure 2A:
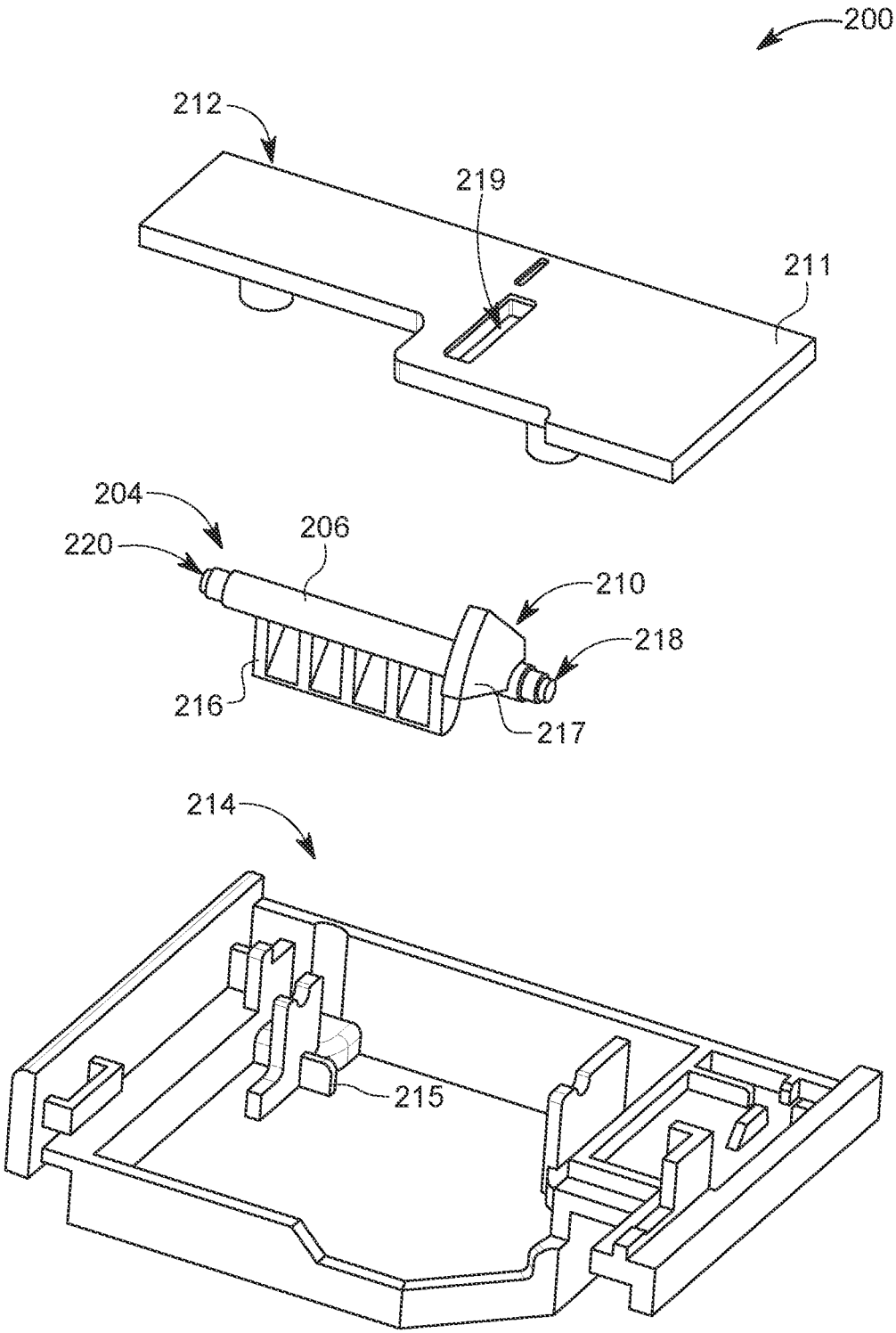
FIGS. 2A-2C illustrate an example sheet guide device that includes a counterweight, in accordance with examples of the present disclosure.
Figure 2B:
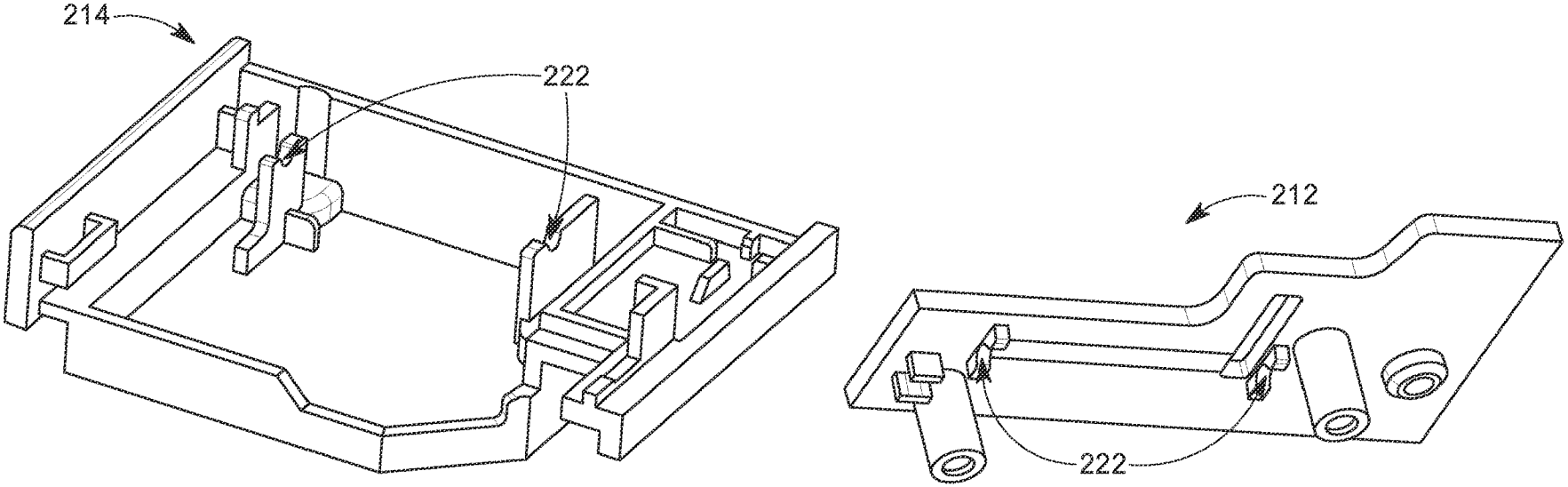
Figure 2C:
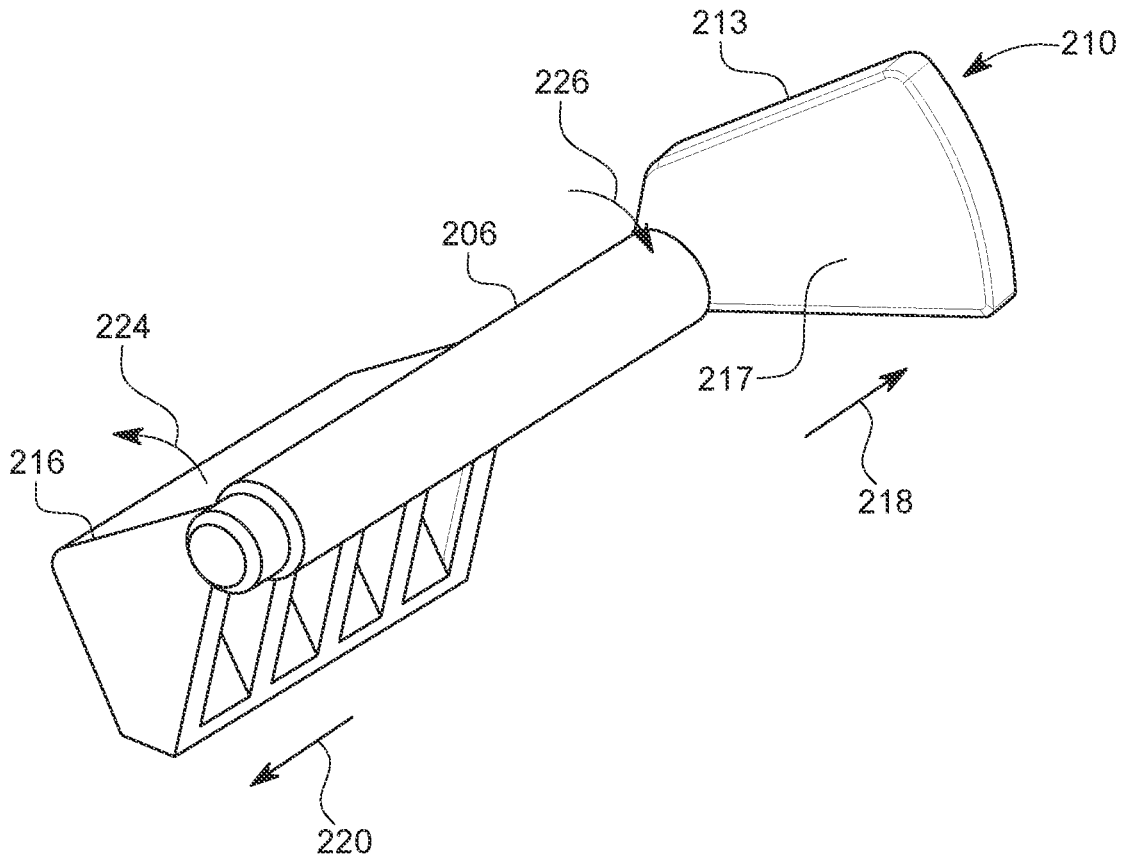

FIGS. 2A-2C illustrate an example sheet guide device that includes a counterweight, in accordance with examples of the present disclosure. In some examples, the sheet guide device 200 of FIGS. 2A-2C may include an implementation of the example sheet guide device 100 of FIG. 1, and includes a housing 212, 214 and a guide member 204, as previously described in connection with FIG. 1, with the housing including or formed by a platform portion 212 and a base portion 214 and the counterbalance component of the guide member 204 comprising a counterweight 216. For ease of reference, the details of the various features and components are not repeated.

As previously described and in some examples, the guide sheet device 200 includes the guide member 204 that comprises a cylinder shaft 206, a counterweight 216, and a guide arm 210. The counterweight 216 is disposed off-center from a central axis of the cylinder shaft 206 in a first direction and the guide arm 210 is disposed off-center from the central axis of the cylinder shaft 206 in a second direction. For example, the counterweight 216 may be disposed off-center from the central axis in a right direction and the guide arm 210 may be disposed off-center in a left side, or vice versa. In some examples, the counterweight 216 and a guide arm 210 may be positioned at different axial positions of the cylinder shaft 206. The guide arm 210 may be disposed on or proximal to a first end 218 of the cylinder shaft 206 and the counterweight 216 may be disposed or extend proximal to a second end 220 of the cylinder shaft 206.

FIG. 2C illustrates a close-up view of the guide member 204 with the counterweight 216 disposed off-center from a central axis in the first direction 224 and the guide arm 210 disposed off-center from the central axis in the second direction 226. As illustrated, the guide arm 210 may be shaped similar to or be referred to as a flag. The counterweight 216 may shift a center of gravity of the guide member 204 toward the first direction 224 and gravity may cause rotational movement of the cylinder shaft 206 in the first direction 224 due to the shifted center of gravity. In some examples, the two-thirds of the mass of the guide member 204 may be to the left the centroid of the cylinder shaft 206.

FIG. 2B illustrates a close-up view of the platform portion 212 and the base portion 214. The platform portion 212 includes a planar surface 211 to receive a stack of sheets and a slot aperture 219. The base portion 214 may couple to the platform portion 212. For example, the base portion 214 and/or platform portion 212 may include connectors, fasteners, joints, or other affixing material or sources that mate with components of the opposing portion. As an example, the platform portion 212 may include male connectors that mate with female connectors of the base portion 214, or vice versa. The base portion 214 and platform portion 212 include supports 222 to couple to the cylinder shaft 206 to rotatably mount the guide member 204 within the housing 212, 214. For example, the supports 222 may couple to the first end 218 and the second end 220 of the cylinder shaft 206. When coupled, the guide arm 210 is to retractably protrude through the slot aperture 219.

Referring back to FIG. 2C, the guide arm 210 may include a guide surface 217. When the platform portion 212, base portion 214, and guide member 204 are coupled, the guide surface 217 may retractably extend through the slot aperture 219 and in a direction that is perpendicular to the planar surface 211 of the platform portion 212. The guide arm 210 may further include a ramped side surface 213. When the platform portion 212, base portion 214, and guide member 204 are coupled, the ramped side surface 213 may be disposed at an angle with respect to the planar surface 211 of the platform portion 212. The ramped side surface 213 may be disposed to angle away from a user that is inserting a stack of sheets to the sheet guide device 200.

The guide surface 217 may be used to guide a stack of sheets for a corner staple, such as when the guide member 204 is in the first state as previously described. The ramped side surface 213 may be used to guide the stack of sheets over and to cause rotational movement of the cylinder shaft 206 such that the guide arm 210 is rotated toward the base portion 214 and beneath the planar surface 211 of the platform portion 212 and the counterweight 216 is rotated toward the platform portion 212, such as being rotated in the second direction 226 to the second state. When the guide member 204 is the second state, an edge staple may be provided as previously described. The first state may be caused by gravity, which may be referred to as a "resting state". The second state is caused by a force provided on the guide member 204 from a stack of sheets, which causes the guide arm 210 to rotate downward and below the planar surface 211 of the platform portion 212. Once the stack of sheets are removed from the planar surface 211, the shifted center of gravity of the guide member 204 causes the guide member 204 to rotate in the first direction 224 back to the first state, with the counterweight 216 striking a protrusion 215 of the housing to ensure the position of the first state is repeatable and accurate. In some examples, the base portion 214 of the housing includes the protrusion 215; however, examples are not so limited.

However, examples are not limited to counterweights. In various examples, a counterbalance component may include a torsion spring disposed with the cylinder shaft 206. Further examples may include both a counterweight 216 and a torsion spring.

In some examples, the sheet guide device 200 may form part of an apparatus that includes a stapler and/or a printing device. For example, the apparatus may further include a stapler disposed with the platform portion 212 to staple the stack of sheets together. In some examples, the sheet guide device 200 is an integrated accessory piece of a printing device which includes an integrated stapler.

Figure 3:
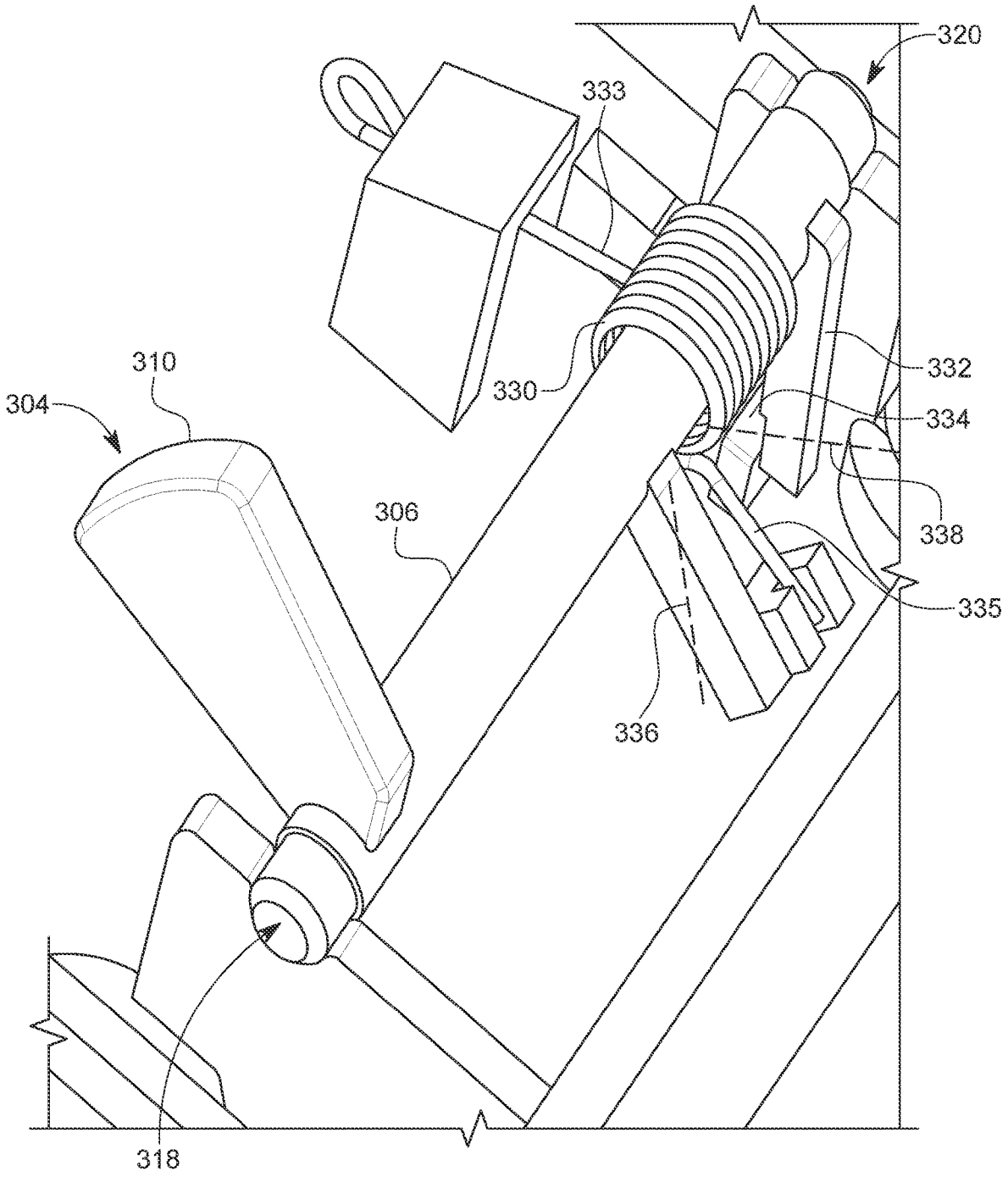
FIG. 3 illustrates an example sheet guide device that includes a tension spring, in accordance with examples of the present disclosure.

FIG. 3 illustrates an example sheet guide device that includes a tension spring, in accordance with examples of the present disclosure. In some examples, the sheet guide device of FIG. 3 may include an implementation of the example sheet guide device 100 of FIG. 1, and includes a housing (not illustrated) and a guide member 304, as previously described in connection with FIG. 1, with the counterbalance component of the guide member 304 comprising a torsion spring 330. For ease of reference, the details of the various features and components are not repeated.

As shown, the torsion spring 330 is disposed with the cylinder shaft 306 to provide a return force to the guide member 304. The torsion spring 330 shifts the center of gravity of the guide member 304 in a first direction, as previously described. As shown, the guide arm 310 is located proximal to a first end 318 of the cylinder shaft 306 and the torsion spring 330 is located proximal to a second end 320 of the cylinder shaft 306 that is opposite the first end 318. The torsion spring 330 may include a number of turns that wrap around the cylinder shaft 306 and includes a first leg 333 and a second leg 335 that is shorter than the first leg 333. The second leg 335 may have two rotated positions 336, 338 when the guide member 304 is in a first state and a second state. For example, when the guide member 304 is in the first state, the second leg 335 may be in the first rotated position 336, which may be the shape of the torsion spring 330 when the torsion spring 330 is unconstrained or only has a gravitation force acting on the guide arm 310. The torsion spring 330 may exert a force to overcome the gravitational force acting on the guide arm 310, which in the absence of the torsion spring 330, may cause the cylinder shaft 306 to rotate. A protrusion 334 on the housing may contact a protrusion 332 on the guide member 304 which prevents additional rotation of the cylinder shaft 306.

When additional force is provided on the guide arm 310 and the guide member 304 is in the second state, the second leg 335 may be in the second rotated position 338. When the additional force, such as a stack of sheets being guided over a ramped side surface of the guide arm 310 is removed, the torsion spring 330 returns to the first rotated position 336.

FIGS. 4A-4F illustrate operation of an example sheet guide device, in accordance with examples of the present disclosure. The sheet guide device 400 may include any of the devices described herein. In some examples, the sheet guide device 400 may be providing an edge staple.

In some examples, the sheet guide device of FIGS. 4A-4F may include an implementation of the example sheet guide device 100 of FIG. 1. For example and referring to FIG. 4A, the sheet guide device 400 may comprise a housing 402 including a slot aperture disposed on a planar surface 411 to receive the stack of sheets, and a guide member 404 coupled to the housing 402, as previously described by FIG. 1. For ease of reference, the details of the various features and components are not repeated.

The housing 402 may include supports coupled to a first end and a second end of the cylinder shaft 406 to allow rotational movement of the cylinder shaft 406. The housing 402 may further include a protrusion 415 disposed to prevent the rotational movement of the cylinder shaft 406 past a threshold rotated position. As previously described, the housing 402 may include a platform portion including the planar surface 411 and the slot aperture, and a base portion coupled to the platform portion, wherein the base portion and the platform portion include the supports.

Figure 4A:
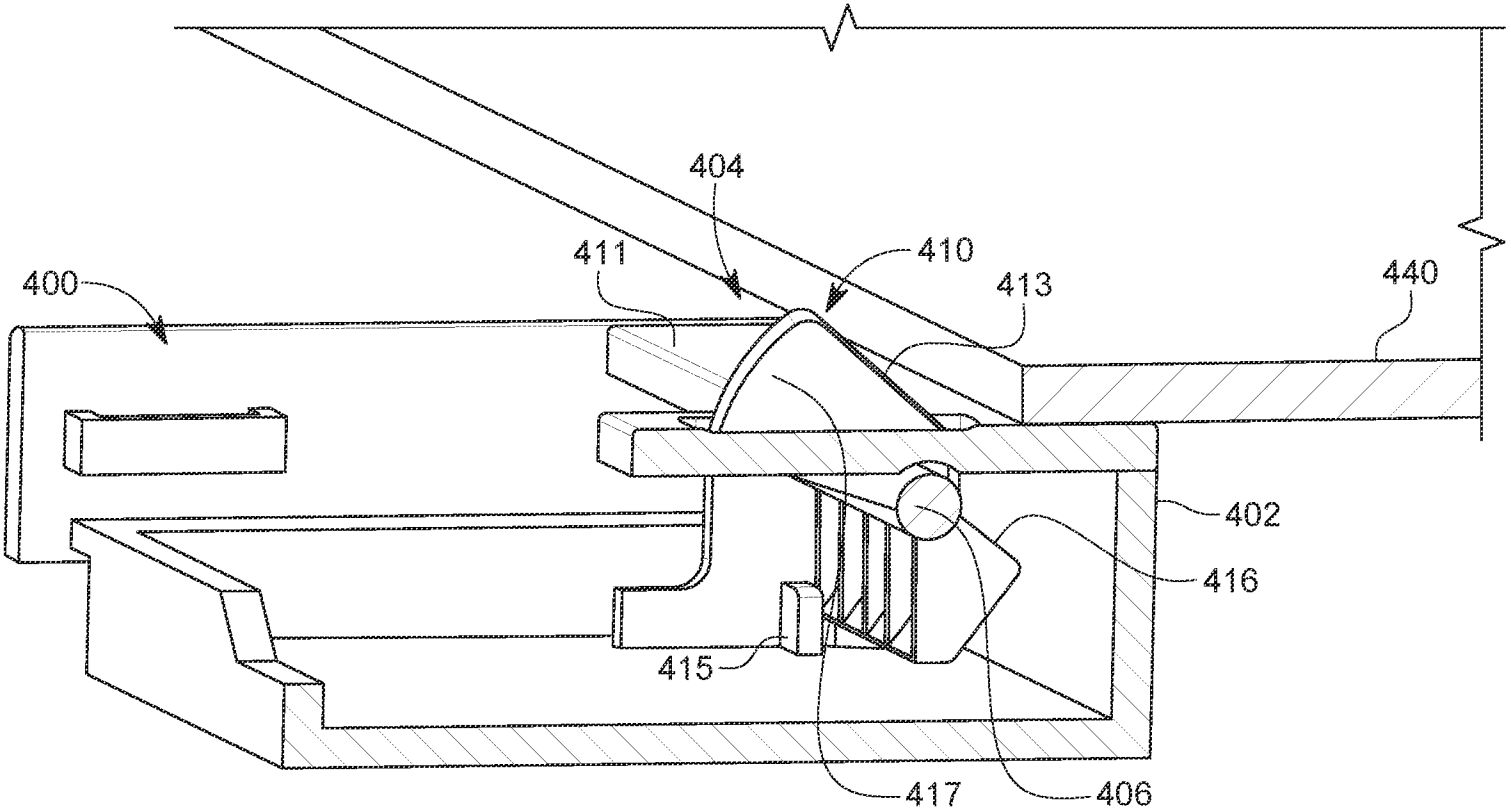
FIGS. 4A-4F illustrate operation of an example sheet guide device, in accordance with examples of the present disclosure.
Figure 4B:
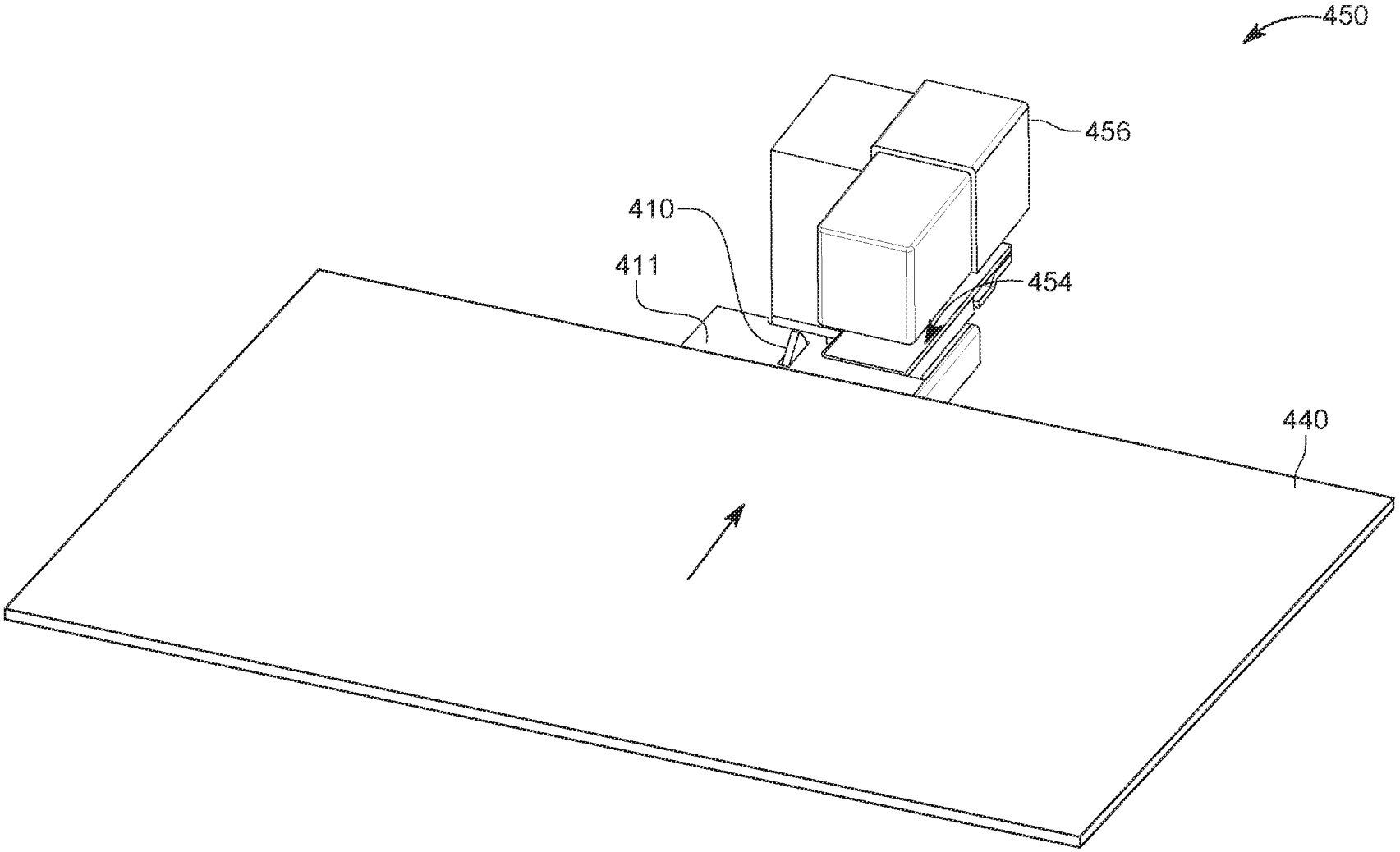
Figure 4C:
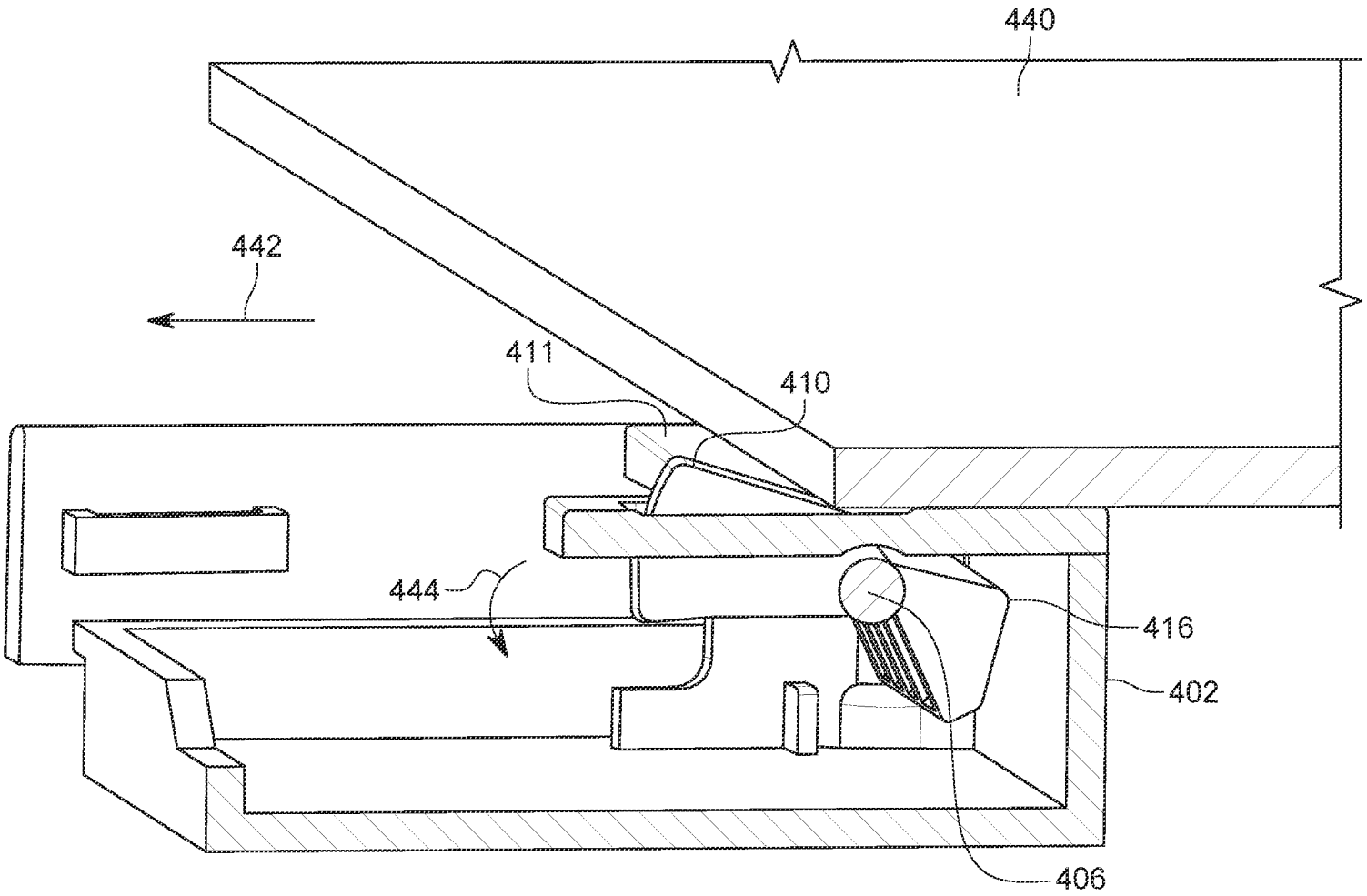
Figure 4D:
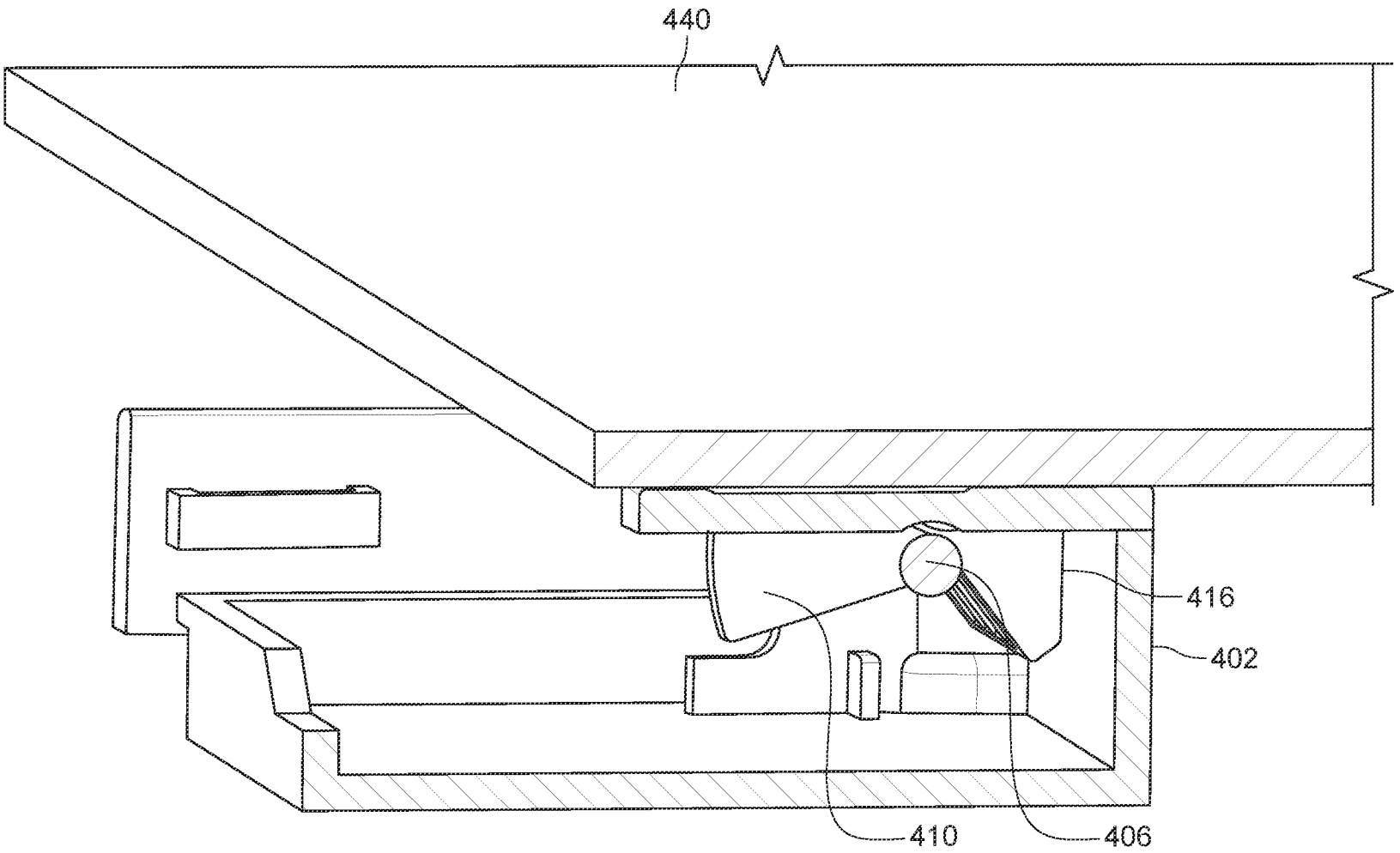
Figure 4E:
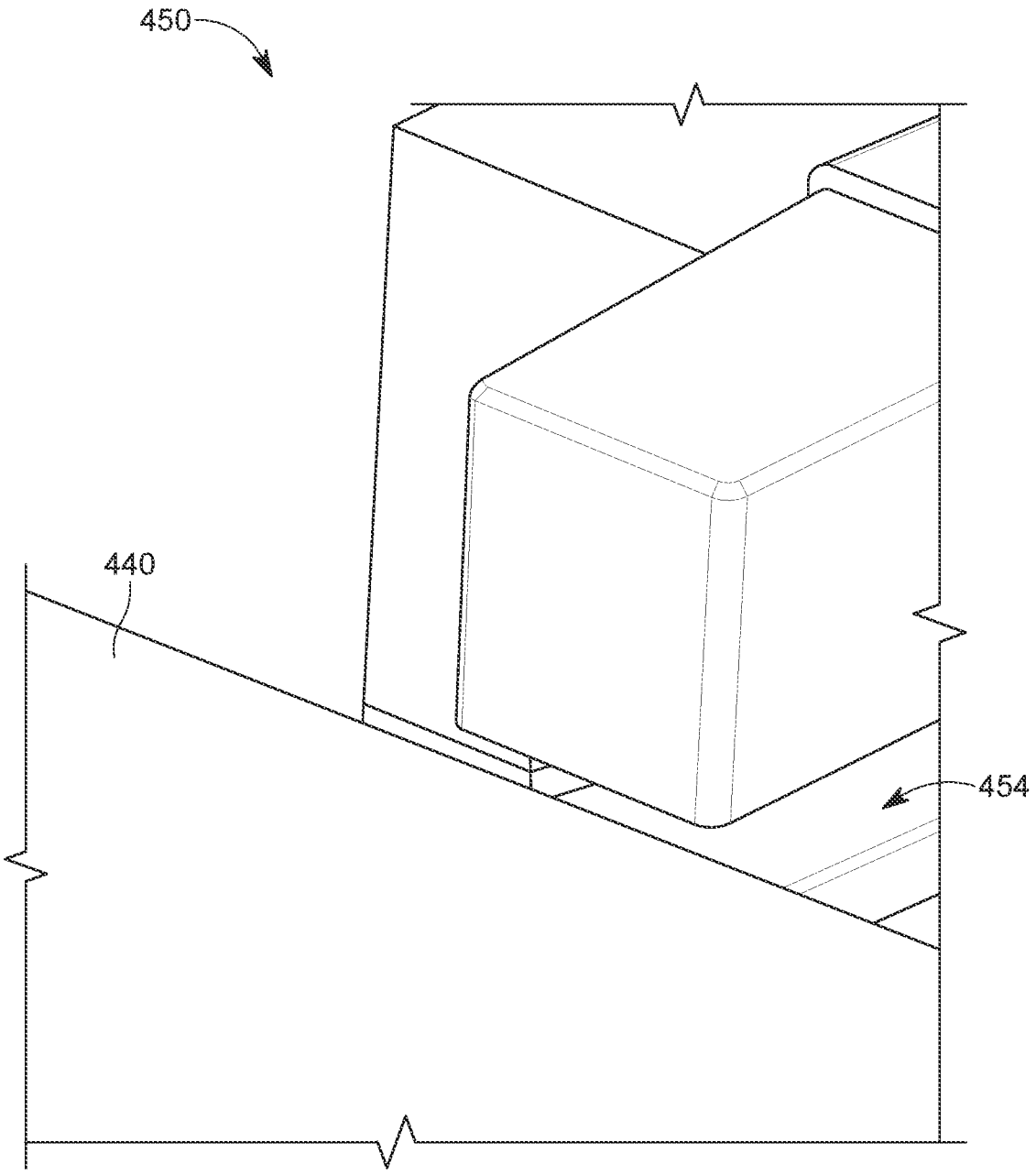

As illustrated by FIGS. 4B and 4E, various examples are directed to an apparatus 450 that includes the sheet guide device 400 and a stapler 454 coupled to the sheet guide device 400 to staple a stack of sheets. In some examples, the apparatus 450 includes the sheet guide device 400, the stapler 454, and a printing device 456 coupled to the stapler 454. The printing device 456 may generate content on the stack of sheets.

In various examples and as illustrated by FIGS. 4A-4F, the counterbalance component includes a counterweight 416 that is disposed off-center from the central axis of the cylinder shaft 406. However examples are not so limited and may additionally or alternatively include a torsion spring as illustrated by FIG. 3. The guide member 404 may be in a first state in which the counterweight 416 and gravity cause the cylinder shaft 406 to be in a first rotated position and the guide arm 410 protrudes through the slot aperture, the guide arm 410 including a guide surface 417 disposed perpendicular to the planar surface 411 of the housing 402 to guide the stack of sheets 440 to the stapler 454. The guide member 404 may transition to a second state in response to a force provided on a ramped side surface 413 of the guide arm 410 which causes the cylinder shaft 406 to rotate to a second rotated position and the guide arm 410 is disposed within the housing 402. The stack of sheets 440 may be uninterrupted by the guide member 404 when the guide member 404 is in the second state. The stapler 454 is coupled to the sheet guide device 400 to staple the stack of sheets using a corner staple when the sheet guide device 400 is in the first state, and an edge staple when the sheet guide device 400 is in the second state.

For example and referring to FIG. 4A, FIG. 4A illustrates a side view of the guide member 404 in a first state in which the guide arm 410 is protruding though the slot aperture of the housing 402. FIG. 4B illustrates a top view of the guide member 404 in the first state. As shown by FIGS. 4A-4B, a stack of sheets 440 to be stapled is positioned for an edge staple by a user, such that the stack of sheets 440 may be guided over a ramped side surface 413 of the guide member 404 and toward the stapler 454 which may be integrated with the printing device 456. While in the first state, as shown by the side view of FIG. 4A, a protrusion 415 in the housing 402 may prevent the cylinder shaft 406 from rotating past a threshold rotated position.

FIG. 4C illustrates a side view of the guide member 404 as the guide member 404 transition from the first state, illustrated by FIG. 4A, to a second state as the stack of sheets 440 is guided over the ramped side surface 413 of the guide arm 410. The stack of sheets 440 may be moved in the direction illustrated by the first arrow 442 and toward the stapler. The stack of sheets 440 may cause force, in addition to gravity, on the guide arm 410, which causes the cylinder shaft 406 to rotate as illustrated by the second arrow 444. In some examples, the cylinder shaft 406 may rotate counter-clockwise, although examples are not so limited. FIG. 4D illustrates a side view of the guide member 404 in the second state. The cylinder shaft 406 may rotate in the direction of the second arrow 444 until the guide arm 410 is beneath the planar surface 411 of the housing 402. While in the second state, the guide member 404 may be disposed within the housing 402 and may not impede the stack of sheets 440 from moving to the stapler and the stapler may perform an edge staple. In various examples, the edge staple may include a plurality of staples along the edge of the stack of sheets 440.

Figure 4F:
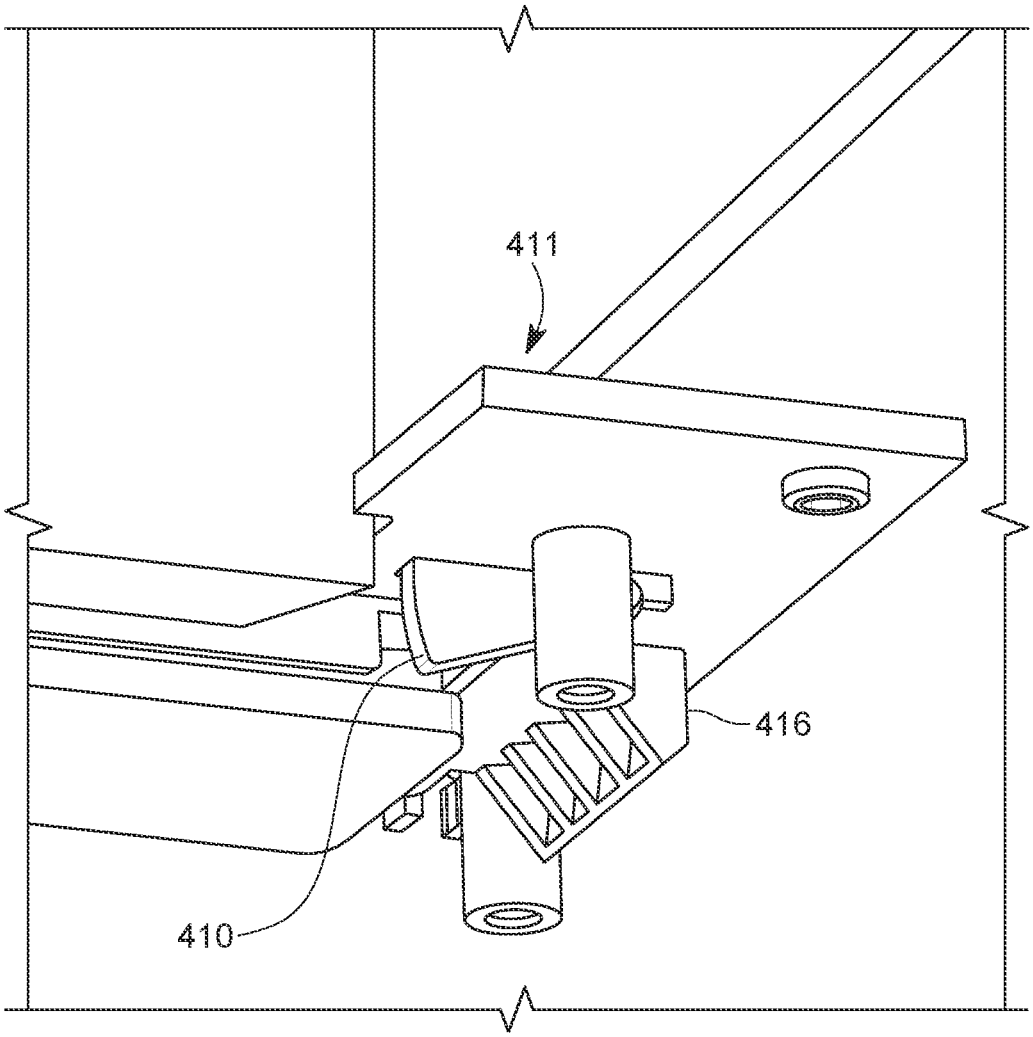

FIG. 4E illustrates a top view of the guide member 404 in the second state and FIG. 4F illustrates a bottom view of the guide member 404 in the second state from inside the housing. After removing the stack of sheets 440, the guide member 404 may rotate back to the first state illustrated by FIG. 4A. The rotation may be in the opposite direction, such as in a clockwise direction.

Figure 5A:
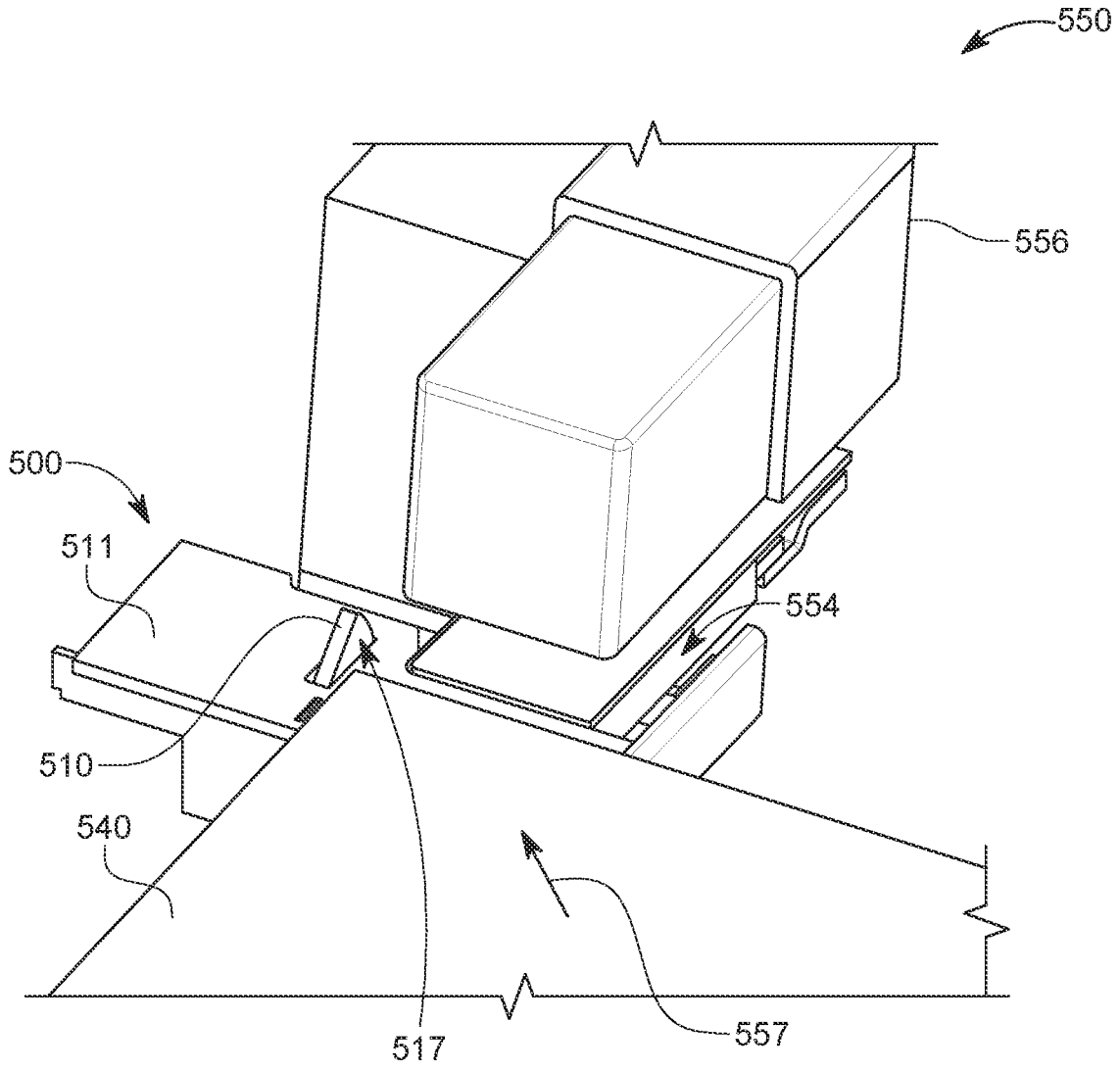
FIGS. 5A-5B illustrate an example sheet guide device providing a corner staple, in accordance with examples of the present disclosure.
Figure 5B:
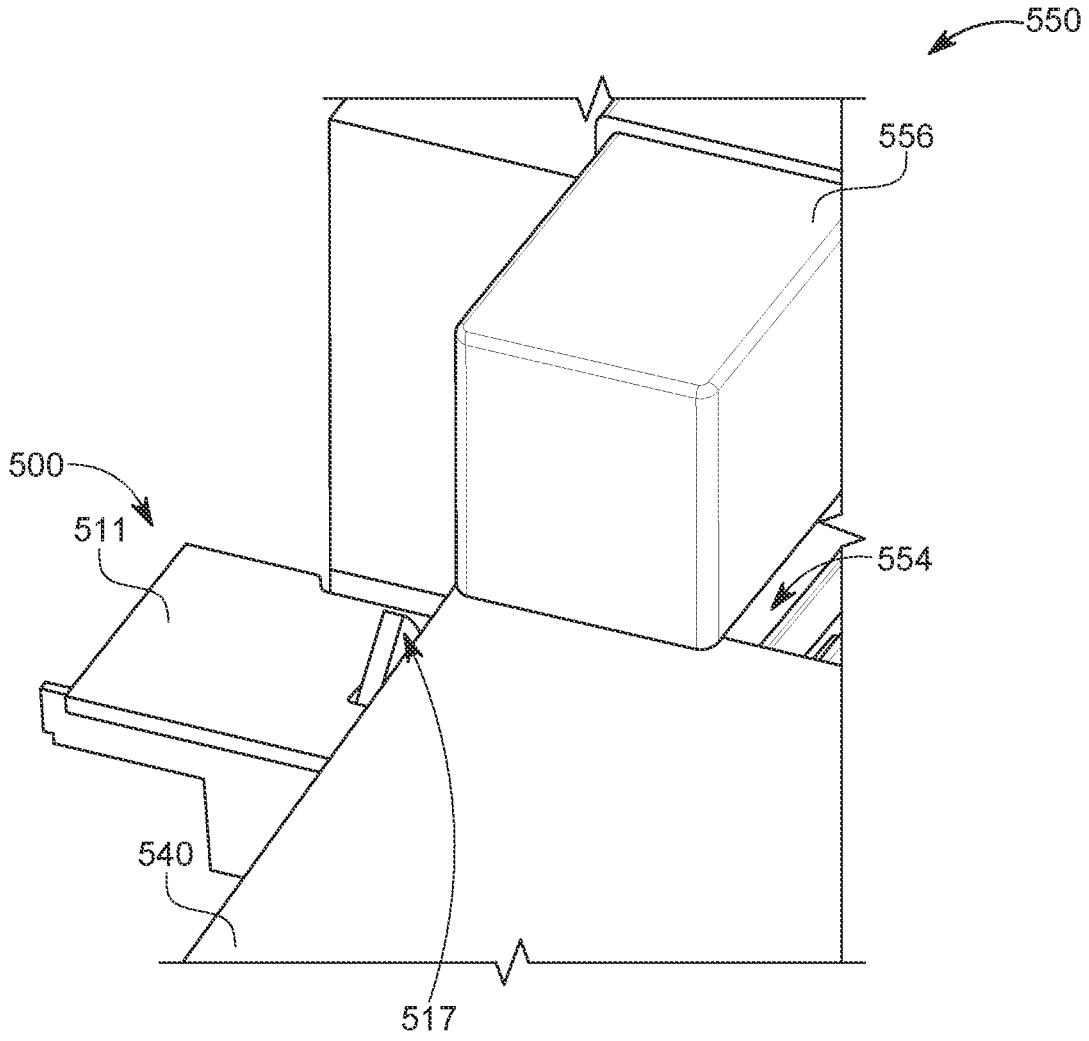

FIGS. 5A-5B illustrate an example sheet guide device providing a corner staple, in accordance with examples of the present disclosure. The sheet guide device 500 of FIGS. 5A-5B may include an implementation of the example sheet guide device 100 of FIG. 1, and includes a housing including a slot aperture with a planar surface 511 and a guide member coupled to the housing, as previously described in connection with FIG. 1. As with FIGS. 4A-4F, the sheet guide device 500 may form part of an apparatus 550 that further includes a stapler 554 and a printing device 556. For ease of reference, the details of the various features and components are not repeated.

FIGS. 5A-5B illustrate a side view of the guide member in a first state in which the guide arm 510 is protruding though the slot aperture of the housing. In the first state, the guide surface 517 is protruding above the planar surface 511 of the housing, such that the guide surface 517 forms a vertical wall. A stack of sheets 540 is presented by a user to the right of the guide arm 510 and moved in a forward-left direction as illustrated by the arrow 557 in FIG. 5A. The stack of sheets 540 come in contact with the guide surface 517, as shown by FIG. 5B, and the guide surface 517 acts as a vertical wall. For example, the guide surface 517 may prevent further movement of the stack of sheets 540 in the left direction. The guide surface 517 may remain above the planar surface 511 and the guide member may not rotate to the second state in response to the stack of sheets 540 pressing the guide surface 517 from the side or perpendicular to the guide surface 517. The stack of sheets 540 may be moved proximal to the stapler 554, and the stapler 554 performs a corner staple.

Various examples are directed to methods of using the example sheet guide devices and/or apparatuses that include a sheet guide device. Such methods may include the operations illustrated by FIGS. 4A-4F and/or FIG. 5A-5B including moving a stack of sheets in a direction toward a guide arm of a sheet guide device while the guide member is in a first state, contacting the stack of sheets perpendicularly to a guide surface of the guide arm, guiding the stack of sheets to a stapler, and causing the stack of sheets to be stapled using a corner staple by the stapler. In other examples or in addition, the method includes moving a stack of sheets over a ramped side surface of a sheet guide device to manually cause the sheet guide device to transition from a first state to a second state in which the guide arm is beneath a planar surface of a housing coupled to the sheet guide device, guiding the stack of sheets to the stapler, causing the stack of sheets to be stapled using an edge staple by the stapler, and removing the stack of sheets to cause the sheet guide device to transition back to the first state.

The sheet guide devices and/or apparatuses including sheet guide devices may transition between the first state and the second state via placement and movement of the stack of sheets by the user, and without further manual toggling of the position or state of the sheet guide device by the user. The different states allow for providing different types of stapling, with the guide member of the sheet guide device automatically transitioning to the different states based on the natural movement of the stack of sheets by the user. The user experience may be improved, as no or minimal instructions may be provided to the user. The sheet guide devices further include minimal moving parts, which are captured by the housing portions. For example, the housing may allow for rotation of the guide member in a controlled direction, such as about the central axis of the cylinder shaft. If a user accidently causes a transition to the second state by placing the stack of sheets too far to the left and causing the guide arm to rotate, a corner staple may still be provided without the use of the guide surface of the guide arm as a vertical wall to guide the stack of sheets.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A sheet guide device comprising:

a housing to receive a stack of sheets to staple, the housing including a platform portion and a base portion coupled to the platform portion; and a guide member coupled to the housing, the guide member comprising:

a cylinder shaft that is rotatable and disposed within the housing;

a counterbalance component disposed with the cylinder shaft to shift a center of gravity of the guide member in a first direction; and a guide arm disposed off-center from a central axis of the cylinder shaft in a second direction, wherein the base portion and the platform portion include supports to couple to the cylinder shaft to rotatably mount the guide member.

2. The device of claim 1, wherein the housing includes a planar surface to receive the stack of sheets and a slot aperture disposed proximal to the guide arm, the guide arm to retractably protrude through the slot aperture and a distance above the planar surface.

3. The device of claim 2, wherein the guide member is in one of:

a first state in which the cylinder shaft is in a first rotated position and the guide arm retractably protrudes through the slot aperture, the guide arm including a guide surface disposed perpendicular to the planar surface of the housing to guide the stack of sheets; and a second state in which the cylinder shaft is in a second rotated position and the guide arm, including the guide surface, is within the housing.

4. The device of claim 2, wherein the guide arm includes a ramped side surface disposed at an angle with respect to the platform portion, the ramped side surface protruding through the slot aperture to guide the stack of sheets over the guide member and to cause rotational movement of the cylinder shaft such that the guide arm is rotated toward and within the housing.

5. The device of claim 4, wherein the ramped side surface of the guide arm forms a vertical wall when the guide member is in a first state in which the cylinder shaft is in a first rotated position and the guide arm retractably protrudes through the slot aperture.

6. The device of claim 5, wherein the ramped side surface is to guide the stack of sheets over the guide member and to cause rotational movement of the cylinder shaft such that the guide member transitions from the first state to a second state in which the cylinder shaft is in a second rotated position and the guide arm is within the housing.

7. The device of claim 2, wherein the guide arm includes a guide surface that retractably extends through the slot aperture and in a direction that is perpendicular to the planar surface of the platform portion.

8. The device of claim 1, wherein:

the counterbalance component includes a counterweight disposed off-center from the central axis of the cylinder shaft in the first direction; and the housing includes:

the supports to couple to a first end and a second end of the cylinder shaft and to allow rotational movement of the cylinder shaft; and a protrusion disposed to prevent the rotational movement of the cylinder shaft past a threshold rotated position.

9. The device of claim 1, wherein the counterbalance component includes a torsion spring disposed within the housing to provide a return force to the guide member in the first direction.

10. The device of claim 1, wherein the housing further includes a protrusion disposed to prevent rotational movement of the cylinder shaft past a threshold rotated position.

11. The device of claim 1, wherein the supports couple to a first end and a second end of the cylinder shaft.

12. A sheet guide device comprising:

a guide member comprising:

a cylinder shaft;

a counterweight disposed off-center from a central axis of the cylinder shaft in a first direction; and a guide arm disposed off-center from the central axis of the cylinder shaft in a second direction;

a platform portion including a planar surface to receive a stack of sheets and a slot aperture, the guide arm to retractably protrude through the slot aperture; and a base portion coupled to the platform portion, wherein the base portion and the platform portion include supports to couple to the cylinder shaft to rotatably mount the guide member.

13. The device of claim 12, wherein:

the counterweight provides a center of gravity of the guide member toward the first direction, and gravity is to cause rotational movement of the cylinder shaft in the first direction; and the guide arm includes a guide surface extending through the slot aperture and in a direction perpendicular to the planar surface of the platform portion.

14. The device of claim 12, wherein the guide arm includes a ramped side surface disposed at an angle with respect to the platform portion, the ramped side surface to guide the stack of sheets over and to cause rotational movement of the cylinder shaft such that the guide arm is rotated toward the base portion and beneath the planar surface of the platform portion and the counterweight is rotated toward the platform portion.

15. The device of claim 12, wherein the base portion and platform portion form a housing, the device further including a stapler disposed with the platform portion to staple the stack of sheets together and a torsion spring disposed with the cylinder shaft to provide a return force to the guide member.

16. An apparatus comprising:

a stapler to staple a stack of sheets; and a sheet guide device coupled to the stapler, the sheet guide device comprising:

a housing including a slot aperture disposed on a planar surface to receive the stack of sheets; and a guide member coupled to the housing, the guide member comprising:

a cylinder shaft that is rotatable within the housing;

a counterbalance component disposed with the cylinder shaft to shift a center of gravity of the guide member in a first direction; and a guide arm disposed off-center from a central axis of the cylinder shaft in a second direction, the guide arm to retractably protrude through the slot aperture.

17. The apparatus of claim 16, wherein the housing includes:

supports coupled to a first end and a second end of the cylinder shaft to allow rotational movement of the cylinder shaft; and a protrusion disposed to prevent the rotational movement of the cylinder shaft past a threshold rotated position.

18. The apparatus of claim 16, wherein:

the guide member is in a first state in which the counterbalance component and gravity cause the cylinder shaft to be in a first rotated position and the guide arm protrudes through the slot aperture, the guide arm including a guide surface disposed perpendicular to the planar surface of the housing to guide the stack of sheets to the stapler;

the guide member is to transition to a second state in response to a force provided on a ramped side surface of the guide arm which causes the cylinder shaft to rotate to a second rotated position and the guide arm is disposed within the housing, the stack of sheets being uninterrupted by the guide member when the guide member is in the second state; and the stapler is coupled to the sheet guide device to staple the stack of sheets using:

a corner staple when the sheet guide device is in the first state; and an edge staple when the sheet guide device is in the second state.

19. The apparatus of claim 16, wherein the counterbalance component includes a counterweight, the apparatus further including:

a printing device coupled to the stapler, the printing device to generate content on the stack of sheets; and wherein the housing includes:

a platform portion including the planar surface and the slot aperture; and a base portion coupled to the platform portion, wherein the base portion and the platform portion include supports to couple to a first end and a second end of the cylinder shaft such that the guide member is rotatably mounted in the housing; and wherein the guide arm is disposed proximal to the first end of the cylinder shaft and the counterweight is disposed proximal to the second end of the cylinder shaft.

* * * * *